United States Patent [19]

Sidor

[11] 4,016,523

[45] Apr. 5, 1977

[54] THERMAL SWITCH DEVICE

[75] Inventor: Edward Frank Sidor, Lombard, Ill.

[73] Assignee: Illinois Tool Works Inc., Chicago, Ill.

[22] Filed: Dec. 22, 1975

[21] Appl. No.: 642,973

[52] U.S. Cl. ..... 337/403; 337/404; 337/407

[51] Int. Cl.² ..... H01H 37/76

[58] Field of Search ..... 337/401, 402, 403, 404, 337/405, 406, 407, 411, 414, 415, 417, 4, 5, 168; 29/623, 622; 169/42

[56] References Cited

UNITED STATES PATENTS

| | | | |
|---|---|---|---|
| 662,032 | 11/1900 | Sitts | 337/407 |
| 2,149,773 | 3/1939 | Huntley | 337/404 |
| 3,198,914 | 8/1965 | Baran | 337/414 |
| 3,519,972 | 7/1970 | Merrill | 337/407 |
| 3,956,725 | 5/1976 | Merrill et al. | 337/407 |

*Primary Examiner*—Harold Broome
*Attorney, Agent, or Firm*—Thomas Buckman; Robert W. Beart

[57] ABSTRACT

A thermal switch for automatically opening a circuit when the ambient temperature is increased to a predetermined level. A pair of conductor wires are arranged in side by side fashion with extremities extending in the same direction. A first spring portion is included in at least one of the conductor wires to provide stored energy when the spring is biased into electrical contact with each other. A localized contact region is included in the conductor wire in the region below the first spring portion. A second spring portion is also included in the conductor wire between the first spring and the associated extremity of the wire. The extremities, contact region, and spring regions being encapsulated with a heat fusible material which biases the conductor wires into contact with each other in a preloaded condition. A coating of rigid insulating material, retaining the conductor wires electrically insulated from each other except at the contact region, is provided over the heat fusible material. The conductors are held in electrical contact until the temperature level reaches the level at which the fusible material flows which thereby allows the contacts to be separated due to the energy stored by the spring.

6 Claims, 9 Drawing Figures

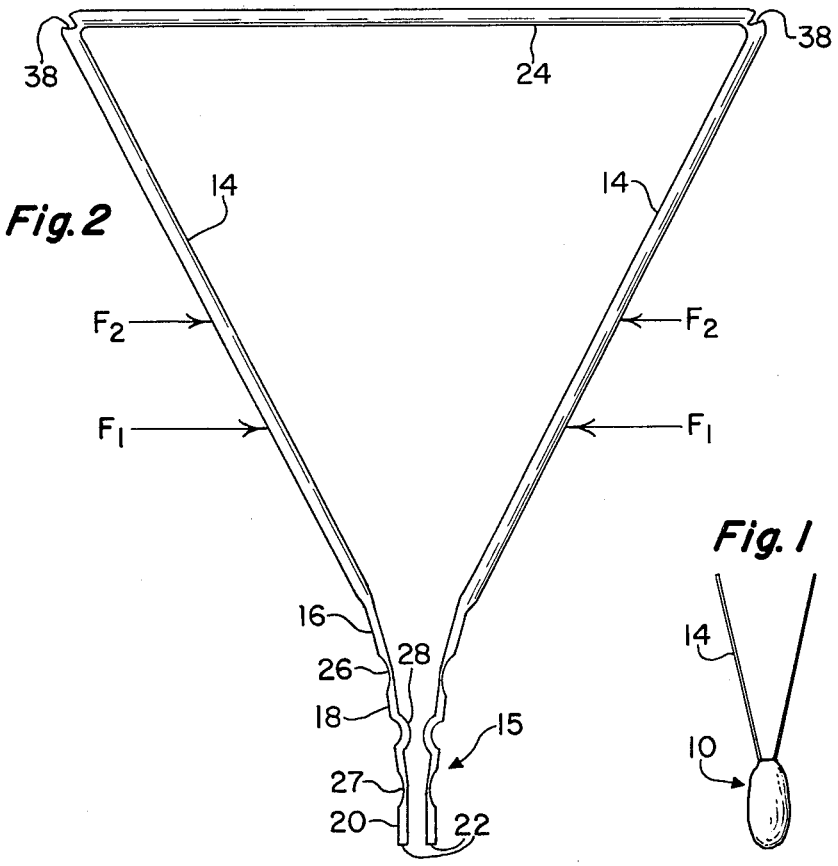
Fig. 2
Fig. 1
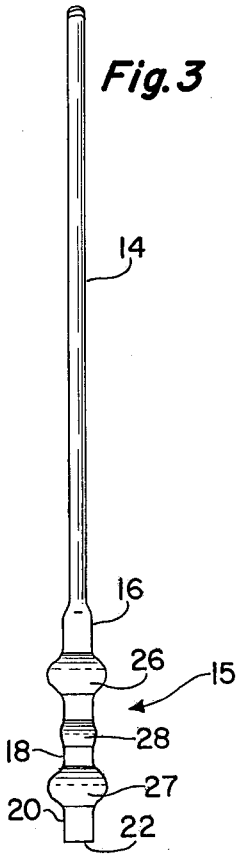
Fig. 3
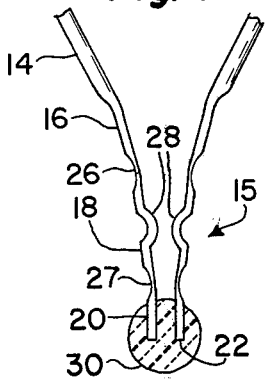
Fig. 4
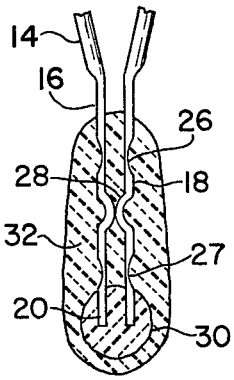
Fig. 5
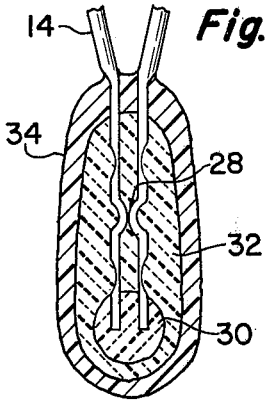
Fig. 6
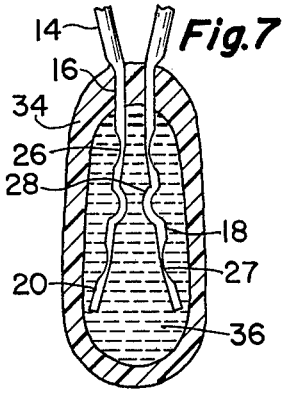
Fig. 7
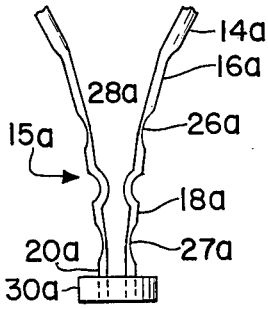
Fig. 8
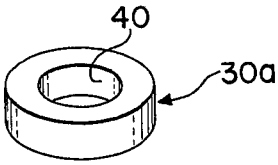
Fig. 9

THERMAL SWITCH DEVICE

BACKGROUND OF THE INVENTION

This invention relates generally to a switch which is responsive to an ambient temperature level.

The invention more particularly relates to an unresettable switch which will open a circuit when the ambient temperature around the circuit is increased to a predetermined level.

Switches of the type described have become necessary to protect various circuitry in devices such as appliances, etc., from the hazards of high temperatures generated therein. An increasing awareness of the hazards that present themselves as a result of a device which is capable of generating unchecked levels of heat emphasizes the importance of incorporating thermal switches in such devices. Not only destruction to the device but to the immediate surroundings could possibly be eliminated through the use of a switch which is capable of accurately sensing the increase in ambient temperature level to a predetermined amount and quickly and reliably opening the circuit to stop the flow of current therein.

Prior art devices of the type described are generally multipiece units with a conductive casing. The multipiece devices of the prior art are inherently costly to produce with a high level of quality control. One such prior art device utilizes a pair of coaxially arranged conductor wires, one of which is electrically connected to an outer conductive casing and the second of which is placed in releasable contact with the conductive casing through a thin washer member. The washer member is urged into contact with the second conductor wire through a spring and a thermal pellet. When a predetermined temperature level is reached, the thermal pellet liquifies, thus releasing the spring energy and allowing a secondary spring to force the washer out of contact with the second conductor wire. Such a device has approximately eight to ten different elements not including the conductor wires.

It is the primary object of the invention to provide a thermal switch device with a minimum of elements.

A further object of the invention is to provide a thermal switch device which is capable of quickly and reliably opening a circuit at a predetermined temperature level.

A still further object of the invention is to provide a thermal switch device which includes a continuous preloading force at the contact regions.

The above and other objects and advantages are achieved by the present ihvention which basically provides for the encapsulation of contact regions of conductor wires, when spring loaded into contact with each other, with a heat fusible material, such as an appropriate organic mixture, followed by a coating or encapsulation of rigid insulating material providing a structural and protective encasement for the circuitry while insulating the conductor wires from one another except at the contact region. The first spring energy is provided in the system by forcing a section of at least one of the conductor wires inwardly against a bias. A secondary spring in the system insures that the contacts will be loaded under a certain spring force. A localized contact region is provided below the first spring region so that contact regions may be forced together into electrical contact by a slight, lateral compression force and dipped or encapsulated in a heat fusible material, followed by a second compressive force to load the spring while dipping or encapsulating the contact region in a similar heat fusible material. The secondary spring region will be located intermediate the first spring and the extremities and preferably between the contact region and the extremities so that the contact region serves as the pivot or fulcrum point on which the spring energy is loaded. This configuration insures a continuous spring loaded contact region.

BRIEF DESCRIPTION OF THE DRAWINGS

FIG. 1 is an elevation of the completed thermal switch being drawn generally to the size and scale as an actual switch constructed in accordance with the invention.

FIG. 2 is an elevational view of a conductive wire preform used in the construction of a preferred embodiment of the invention.

FIG. 3 is a side view of the preform shown in FIG. 2.

FIG. 4 is a partial elevational view of the preform during a first step in the manufacture of a switch in accordance with the invention.

FIG. 5 is a partial elevational view of the preform during a second step in the manufacture of a device in accordance with the invention.

FIG. 6 is a cross-sectional view of the switching portion of the device of the invention in a loaded condition following its final manufacturing step.

FIG. 7 is a cross-sectional view of the device similar to that shown in FIG. 6 after the circuit has opened.

FIG. 8 is a partial elevational view of the switch section of a preform during a first step in an alternate configuration of the manufacture of a switch in accordance with the invention.

FIG. 9 is a perspective of the heat fusible annular ring utilized in the embodiment shown in FIG. 8.

DESCRIPTION OF THE PREFERRED EMBODIMENT

The thermal switch device 10 shown in FIG. 1 and in more detail in FIG. 6 will first be described relative to the various steps to manufacture a preferred embodiment thereof and with particular reference to FIGS. 2–5.

A link of conductive wire is first formed into a generally U-shaped configuration, such as shown in FIG. 2, to include an open portion and a closed bight portion at opposing ends of the preform. The closed portion in the preferred embodiment will be constructed of a lead wire sections 14 which are spaced from one another a distance greater than the switch sections 15 of the wire adjacent the open end of the preform. The switch sections (5 adjacent the open end may consist generally of three subsections 16, 18 and 20. The intermediate subsection 18 will include portions which extend laterally outwardly from the associated upper subsection 16, such as resulting from being formed at an angle to one another and interconnected by a spring-like hinge 26. Likewise, the lower subsection 20 will include portions extending laterally outwardly from the associated intermediate subsection 18 and again resulting from being formed at an angle to one another and interconnected by a spring-like hinge 27. A localized contact region 28 is included in the switch section and is positioned in the intermediate subsection 18. The contact region 28 may be deformed from the switch section as a protuberance or protuberances extending from the opposing faces of conductor wires 14.

A preform in the condition such as typified in FIG. 2 may be subjected to a slight compressive force F1, preferably in the upper region of the preform and exerted on the lead wire portions 14. This initial force will bring the opposing switch sections 15 together so that the contact point or points are closely adjacent or in contact with one another. In this position, the extremity 22 of the lower subsection 20 are dipped in a heat fusible material, such as an organic, having a predetermined melting or flowing temperature. This dipping is, of course, done while the organic is in a liquid state followed by cooling to room temperature, subsequent to the dipping, to produce an initial encapsulation 30 which will hold the switch sections together in the position shown in FIG. 4.

With the preform in the retained position shown in FIG. 4, a further lateral force F2 is applied to the upper region of the preform. This force F2 will be of a greater force than the initial force and of a value great enough to overcome the spring bias of the spring regions 26 and 27 bringing the upper section 16, intermediate section 18 and lower sections 20 generally into alignment. Since both the upper section 16 and lower section 20 are biased laterally outwardly from the intermediate section 18, the contact region 28 will form a fulcrum about which a pair of forces are acting as a result of the energy stored in springs 26 and 27. This condition will have the effect of preloading the switch section at contact points 28 with a predetermined loading force.

With the springs loaded in this manner, the switch section is subjected to a second dip of heat fusible organic material to provide a complete covering 32 of the lower section 20, intermediate section 18, contact point 28, portions of the upper subsection as well as the initial encapsulation 30. The two dips of fusible organic material may be of exactly the same material and become essentially homogeneous. Upon cooling the heat fusible material following this second dip, the circuit will be closed and the springs loaded in a preassembly shown in FIG. 5.

Since the preform includes a bight portion 24 interconnecting the lead wire portions 14, this bight portion must be severed to provide an appropriate electrical component having a pair of leads extending from a switch section. The severing of the bight portion may be facilitated by prenotched sections 38 and the severing is preferably accomplished prior to the second dipping step in order to reduce the shear stress on the contact region.

Following the second dip step, the switch section of the device and the heat fusible encapsulation is totally and conformally coated with a layer of rigid insulating material, such as an epoxy coating 34. This epoxy coating 34 may also be done in a dipping process but conventional casing techniques may be utilized as long as the casing intimately and conformally surrounds the fusible material and provides a structure for protecting the switch circuit while electrically insulating the lead wires at their point of entry into the switch section. The device shown in FIG. 6 thus is representative of the switch in it final loaded condition capable of transmitting current from one lead wire 14 to the other. When the environmental or ambient temperature reaches a predetermined level, the heat fusible organic 30 and 32 will flow or liquify allowing the energy stored in the springs of the system to be released thus providing the open circuit structure shown in FIG. 7. The upper sections 16 will be locked in the epoxy so the intermediate section 18 including the contact region 28 will spring laterally outwardly relative to its opposing wire section to resume a relaxed position as the energy is released in the spring. The cavity within the epoxy coating 34 will contain generally only the heat fusible material so that when the organic melts the displaced organic will flow between the lead wires and increase the dielectric strength between the open contacts. This construction also serves to preclude the formation of a corona discharge since no air will be present to ionize.

In a device of the type described, it is important to insure that a firm electrical contact is present in the switch prior to the attainment of a temperature level. Thus, the positioning of contact regions 28 intermediate a pair of spring regions serves to create a constant and controlled loading at the contact region during the loaded condition. Since the contact region 28 serves as the fulcrum when the spring sections are loaded, the desired preloading can be readily accomplished with the invention described herein.

The lead wire in the switch regions 15 are flat to distribute the contact reaction force and thus reduce the tendency of this energy in the spring system to be dissipated by cold flow of the organic.

While the preferred embodiment describes the initial step of manufacturing to be that of a dipping process, FIG. 8 shows an alternate embodiment to this aspect of the invention. An annular ring type of pellet **30*a* may surround the lower subsection 20*a* in a manner similar to the dip 30 shown in FIG. 4. Following the positionment of the ring type preform in this manner, the switch may be completed in a manner similar to that described relative to the primary embodiment in that the switch sections 16*a*, 18*a* and 20*a* are brought generally into alignment against the bias of the spring regions 26*a* and 27*a*. With an external force exerted on the preform in the manner described previously, the switch region may be then encapsulated with a heat fusible material such as that shown and described relative to FIG. 5 of the primary embodiment. However, the dipping of the organic may be replaced with a cap of solid carbon dioxide or dry ice, or any equivalent material which is solid at a low temperature. This secondary surrounding of heat fusible material may then be coated with rigid insulating material, such as epoxy, and cured. When the epoxy has cured, the device may approach room temperature and the gas within the switch section allowed to escape as it expands. The epoxy coating or cap will then be sealed with a drop or drops of epoxy. A further alternate approach to the manufacture of the device described herein contemplates a cylindrical type of heat fusible organic generally of a length consistent with the length of the switch section 15*a*. The upper regions of such a preform may be placed surrounding the subsections 20*a* and the loading force applied to the upper regions of the preform 14*a*. After this loading force is so applied, the preform may be slid up to entirely surround the switch section 15*a* retain it in a loaded condition in a manner very similar to that shown in the embodiment described as FIG. 5.**

Thus, it is apparent that there has been provided in accordance with the invention a thermal switch device that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations that fall within the spirit and broad scope of the appended claims.

I claim:

1. A thermal switch device comprising a pair of conductor wire members in side by side relationship to each other and having free ends extending generally in the same direction, at least one of said wire members including a first, upper region, a second, intermediate region and a third, lower region including a free extremity of the wire member, a first spring means between the first and second regions biasing the second region outwardly relative to the first region, a second spring means between the second and third regions biasing the third region outwardly relative to the second region, a contact region on the conductor wire member located intermediate the first spring means and the third region, solid heat fusible means surrounding the second and third region and a portion of the first region serving to retain the three regions in a first position against the bias of the first spring means and further bringing the contact regions into electrical contact under the force of the energy created by the second spring means, nonconductive means surrounding the heat fusible means supporting and retaining the first upper regions in a predetermined insulated spaced relationship to each other, wherein the heat fusible means retains the conductor wire members in electrical contact with each other until said heat fusible means is exposed to a predetermined temperature level, wherein the fusible means liquifies responsive to the predetermined temperature, releasing the energy of the spring means to open the circuit between the conductor wire members and place the three regions in a second position.

2. The thermal switch in accordance with claim 1, wherein at least a portion of the heat fusible means is in the form of a preformed pellet with aperture means extending therethrough, said aperture means adapted to receive the free extremities and adjacent portions of the third region of each wire member thereby biasing and preloading the contact regions into firm electrical contact.

3. The thermal switch in accordance with claim 1, wherein the heat fusible means encapsulates the second, third and a portion of the first region when they are in substantial alignment with each other and thereby loaded with the spring energy stored in the first and second spring means.

4. The thermal switch in accordance with claim 1, wherein the contact region includes a protuberance located on the second region intermediate the first and second spring means.

5. The thermal switch in accordance with claim 1, wherein each conductor wire member includes a first, second and third region generally biased away from each other by first and second spring means.

6. The thermal switch in accordance with claim 1, wherein the heat fusible means includes an inner region of organic material surrounding the third region of the one wire member and associated region of the other wire member, an outer region of solid carbon dioxide encapsulating the organic material as well as the first and second spring means, second region and a portion of the first region.

* * * * *